US010612858B2

(12) United States Patent
Seccuro et al.

(10) Patent No.: US 10,612,858 B2
(45) **Date of Patent: *Apr. 7, 2020**

(54) EVAPORATOR

(71) Applicant: Heatcraft Refrigeration Products, LLC, Richardson, TX (US)

(72) Inventors: Scott Seccuro, Stone Mountain, GA (US); Todd Collins, Stone Mountain, GA (US); Subodh Sharma, Stone Mountain, GA (US)

(73) Assignee: Heatcraft Refrigeration Products, LLC, Richardson, TX (US)

( * ) Notice: Subject to any disclaimer, the term of this patent is extended or adjusted under 35 U.S.C. 154(b) by 65 days.

This patent is subject to a terminal disclaimer.

(21) Appl. No.: 16/055,411

(22) Filed: Aug. 6, 2018

(65) Prior Publication Data

US 2018/0340737 A1 Nov. 29, 2018

Related U.S. Application Data

(63) Continuation of application No. 12/969,760, filed on Dec. 16, 2010, now Pat. No. 10,041,737.

(51) Int. Cl.

| | |
|---|---|
| ***F28D 1/047*** | (2006.01) |
| ***F25D 17/06*** | (2006.01) |
| ***F28F 1/04*** | (2006.01) |

(52) U.S. Cl.

CPC ..... *F28D 1/0477* (2013.01); *F25D 17/067* (2013.01); *F25D 2317/0681* (2013.01); *F28F 1/04* (2013.01); *F28F 2250/08* (2013.01); *Y10T 29/49396* (2015.01)

(58) Field of Classification Search

CPC ..... F25D 17/067; F25D 2317/0681; F28D 2250/08; F28D 1/0477; F28D 1/30

See application file for complete search history.

(56) References Cited

U.S. PATENT DOCUMENTS

| | | | | |
|---|---|---|---|---|
| 2,931,562 | A * | 4/1960 | Wistrand | F04D 29/4226 417/363 |
| 3,216,217 | A | 11/1965 | Kesling | |
| 3,665,727 | A * | 5/1972 | Mather | F24F 1/02 62/262 |
| 3,712,078 | A | 1/1973 | Maynard et al. | |
| 4,006,390 | A | 2/1977 | Levine | |
| 4,353,680 | A | 10/1982 | Hiraoka et al. | |
| 5,531,267 | A | 7/1996 | Ahmed et al. | |
| 5,588,484 | A | 12/1996 | Baker et al. | |

(Continued)

FOREIGN PATENT DOCUMENTS

| | | | |
|---|---|---|---|
| DE | 20 2007 015 310 | U1 | 11/2008 |
| EP | 0697574 | A2 | 2/1996 |
| WO | WO-2009/134760 | A2 | 11/2009 |

OTHER PUBLICATIONS

PCT Notification of Transmittal of International Preliminary Report on Patentability, dated Jan. 24, 2013, pp. 1-16.

*Primary Examiner* — Kun Kai Ma
(74) *Attorney, Agent, or Firm* — Winstead PC

(57) ABSTRACT

The present application provides an evaporator. The evaporator may include a housing, a coil assembly mounted within the housing, and a replaceable fan module positioned within the housing. The replaceable fan module may include a fan mounted therein.

20 Claims, 6 Drawing Sheets

(56) References Cited

U.S. PATENT DOCUMENTS

| | | | | |
|---|---|---|---|---|
| 5,878,592 | A * | 3/1999 | Borges | B60H 1/3232 62/239 |
| 5,916,253 | A | 6/1999 | Amr et al. | |
| 5,927,389 | A | 7/1999 | Gonsalves et al. | |
| 5,980,207 | A | 11/1999 | Correll | |
| 6,272,876 | B1 | 8/2001 | Roberts et al. | |
| 6,373,698 | B1 * | 4/2002 | Christensen | G06F 1/20 174/16.1 |
| 6,763,669 | B1 * | 7/2004 | Bushnell | B60H 1/00371 62/115 |
| 6,857,288 | B2 | 2/2005 | Ha et al. | |
| 7,515,413 | B1 * | 4/2009 | Curtis | G06F 1/20 165/104.33 |
| 7,614,242 | B1 * | 11/2009 | Quesada Saborio | B60H 1/3232 62/298 |
| 10,041,737 | B2 * | 8/2018 | Seccuro | F25D 17/067 |
| 2004/0007010 | A1 * | 1/2004 | Kopf | F04D 29/646 62/419 |
| 2004/0197189 | A1 * | 10/2004 | Seo | F04D 29/703 415/121.2 |
| 2005/0095121 | A1 | 5/2005 | Vithani | |
| 2005/0111972 | A1 | 5/2005 | Penlesky et al. | |
| 2009/0165476 | A1 | 7/2009 | Hosaka | |
| 2009/0211287 | A1 * | 8/2009 | Steele | B60H 1/3229 62/259.1 |
| 2010/0018246 | A1 | 1/2010 | Wolfe, IV et al. | |
| 2010/0031684 | A1 | 2/2010 | Spiller | |
| 2010/0064719 | A1 | 3/2010 | Lee et al. | |
| 2010/0226088 | A1 * | 9/2010 | Huang | G06F 1/203 361/679.48 |
| 2010/0275630 | A1 | 11/2010 | DeMonte et al. | |

* cited by examiner

EVAPORATOR

CROSS-REFERENCE TO RELATED APPLICATION

This application is a continuation of U.S. patent application Ser. No. 12/969,760 filed on Dec. 16, 2010. U.S. patent application Ser. No. 12/969,760 is incorporated herein by reference.

TECHNICAL FIELD

The present application relates generally to refrigeration systems and more particularly relates to a modular evaporator and components thereof for use within a walk-in cooler and other types of refrigeration systems.

BACKGROUND OF THE INVENTION

Modern air conditioning and refrigeration systems provide cooling, ventilation, and humidity control for all or part of an enclosure such as a building, a cooler, and the like. Generally described, the refrigeration cycle includes four basic stages to provide cooling. First, a vapor refrigerant is compressed within a compressor at high pressure and heated to a high temperature. Second, the compressed vapor is cooled within a condenser by heat exchange with ambient air drawn or blown across a condenser coil by a fan and the like. Third, the liquid refrigerant is passed through an expansion device that reduces both the pressure and the temperature of the liquid refrigerant. The liquid refrigerant is then pumped within the enclosure to an evaporator. The liquid refrigerant absorbs heat by blowing or drawing air across the evaporator coil as the liquid refrigerant changes to vapor. Finally, the vapor is returned to the compressor and the cycle repeats. Various alternatives on basic refrigeration cycle are known and a so may be used herein.

Conventional walk-in coolers, such as those typically found in the food service industry and the like, generally have an evaporator therein similar to that described above. The evaporator typically is hung from the ceiling of the cooler. The evaporator thus may take up space within the cooler that could have been used for storage or other purposes. The evaporator also may present a hazard in that the evaporator may extend downward into the usual standing area so as to present a risk of injury for individuals walking therein. Likewise, a condensate drain may hang below the evaporator. The condensate drain also may take up useful storage space and itself may be an injury risk.

Typical evaporators generally also require extensive disassembly so as to repair and/or replace a component therein such as a fan and the like. Such disassembly procedures generally involves shutting down the cooler and may involve transferring all of the items stored therein. Moreover, even repairs that do not involve shutting down the cooler at least require the workman to work in the refrigerated space for an extended period of time. Repairing an existing evaporator thus may be a somewhat costly and time intensive procedure. Similarly, installing a new evaporator may be difficult given the typical weight involved and the difficulty in maneuvering in the close spaces typically found therein.

There is a therefore a desire for an improved evaporator design for use within walk-in coolers and other types of refrigeration systems. Such an improved evaporator design preferably may take up less storage space therein and create less of an injury hazard while providing easy access thereto for repair and/or replacement of the components therein.

SUMMARY OF THE INVENTION

The present application thus provides an evaporator. The evaporator may include a housing, a coil assembly mounted within the housing, and a replaceable fan module positioned within the housing. The replaceable fan module may include a mounted therein.

The present application further provides a method of installing an evaporator within a cooler. The method may include the steps of attaching an evaporator housing with a coil assembly mounted therein to the cooler, sliding a replaceable fan module into the housing, and locking the fan module in place.

The present application further provides an evaporator. The evaporator may include a plastic housing, a coil assembly mounted within the housing, and a replaceable fan module slid within the housing. The replaceable fan module may include a backward incline centrifugal fan mounted therein.

These and other features and improvements of the present application will become apparent to one of ordinary skill in the art upon review of the following detailed description when taken in conjunction with the several drawings and the appended claims.

DETAILED DESCRIPTION

Figure 1:
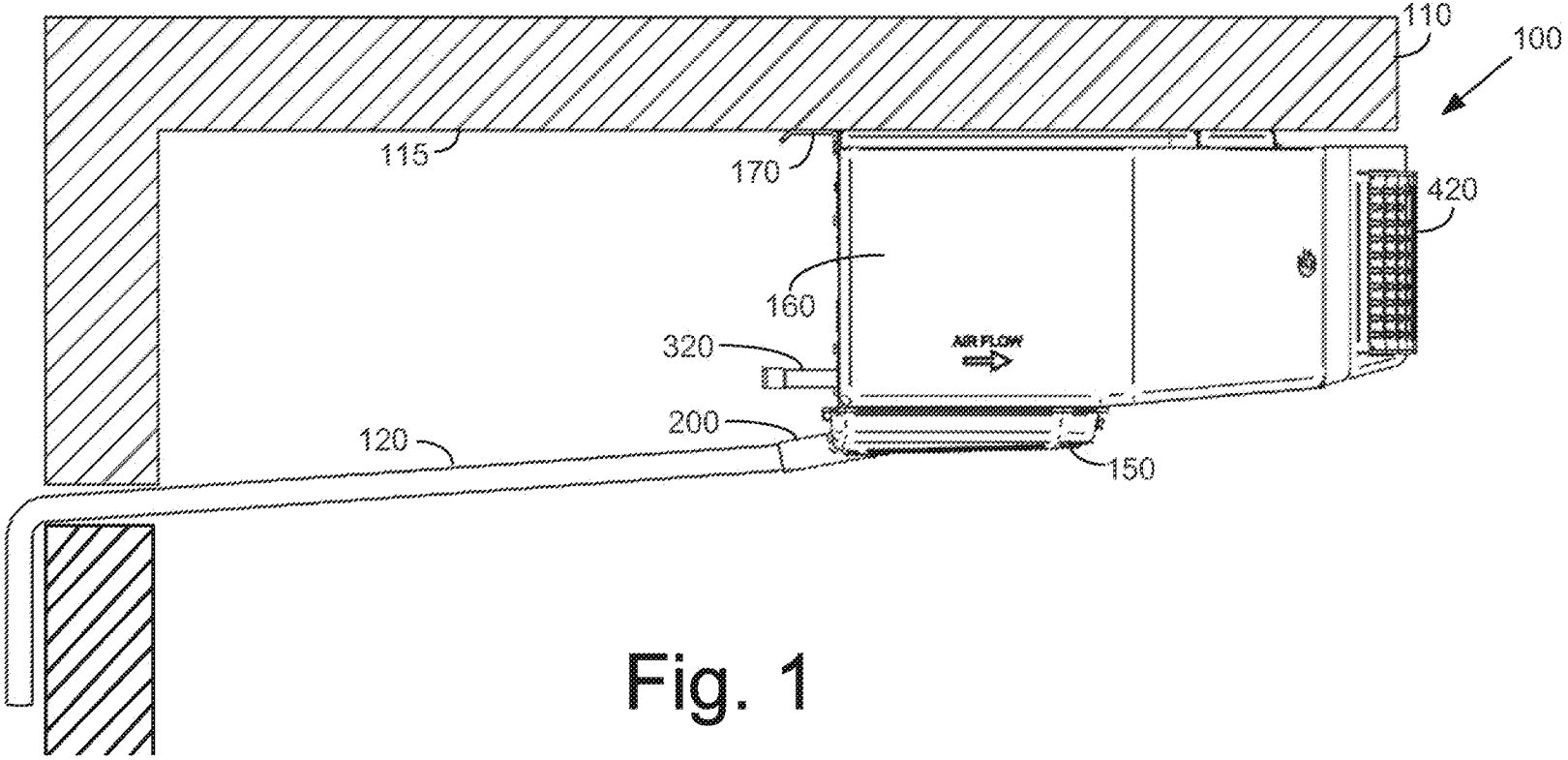
FIG. 1 is a side plan view of an evaporator as may be described herein positioned within a cooler.
Figure 2:
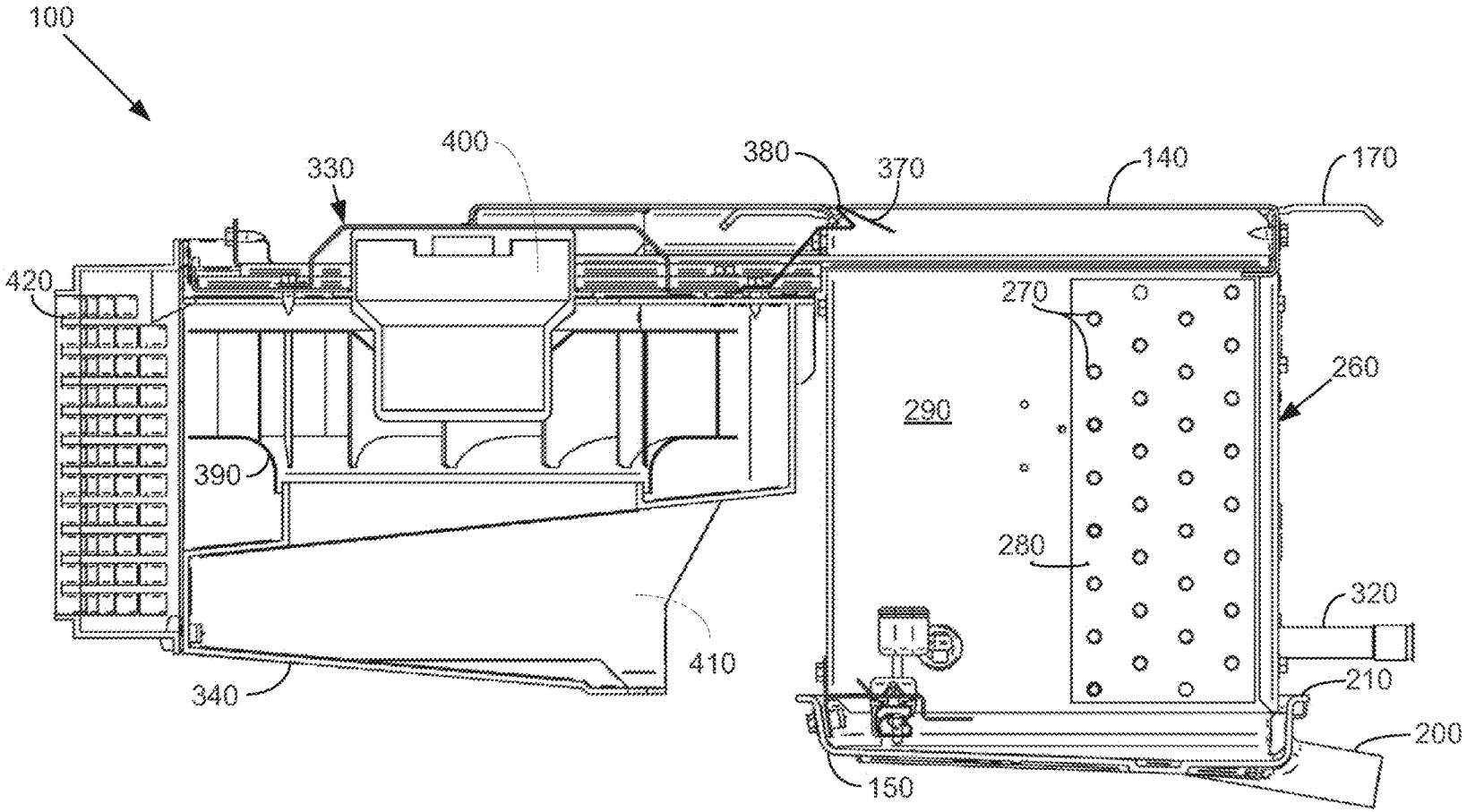
FIG. 2 is a side cross-sectional view of the evaporator of FIG. 1.
Figure 3:
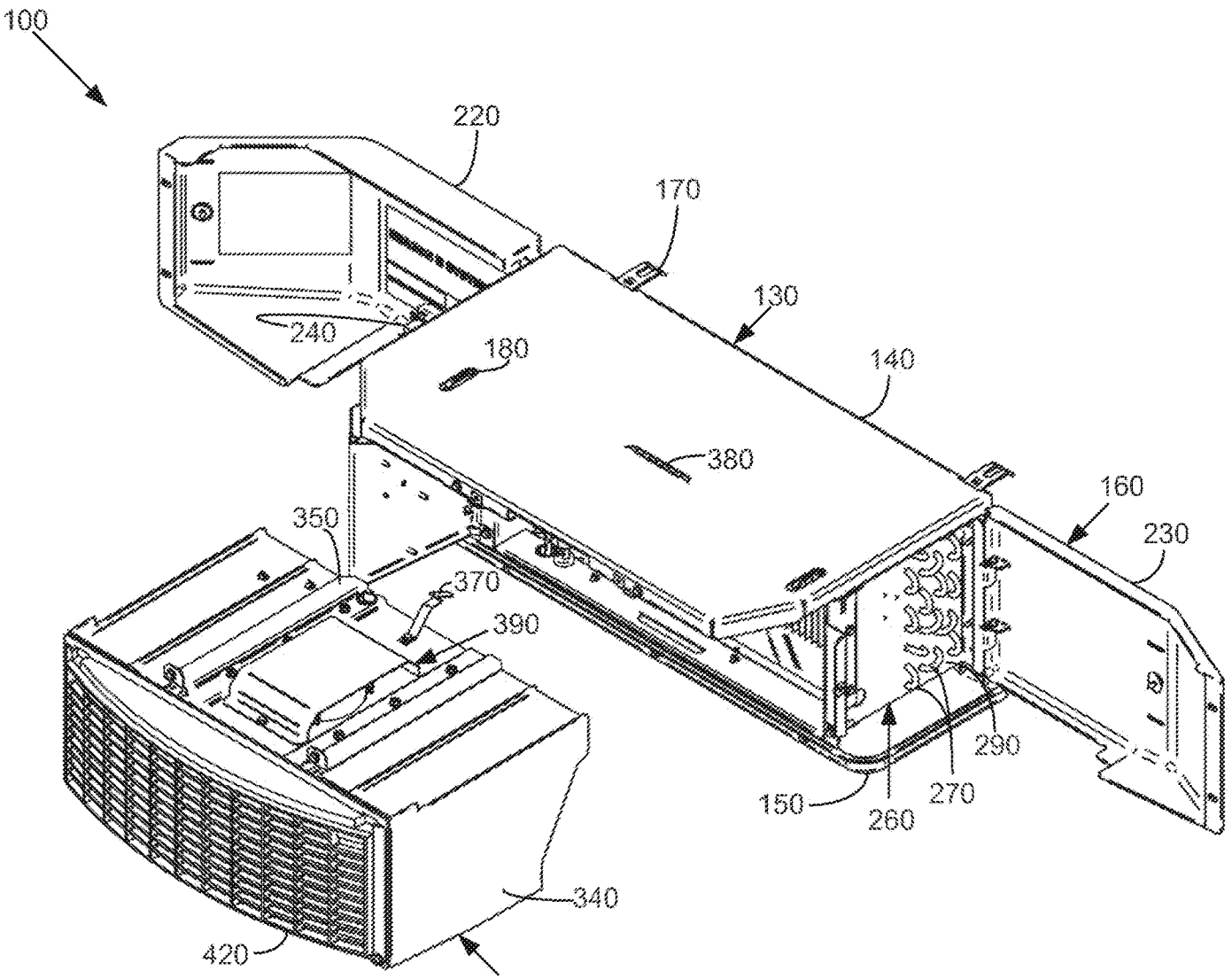
FIG. 3 is an exploded top perspective view of the components of the evaporator of FIG. 1.
Figure 4:
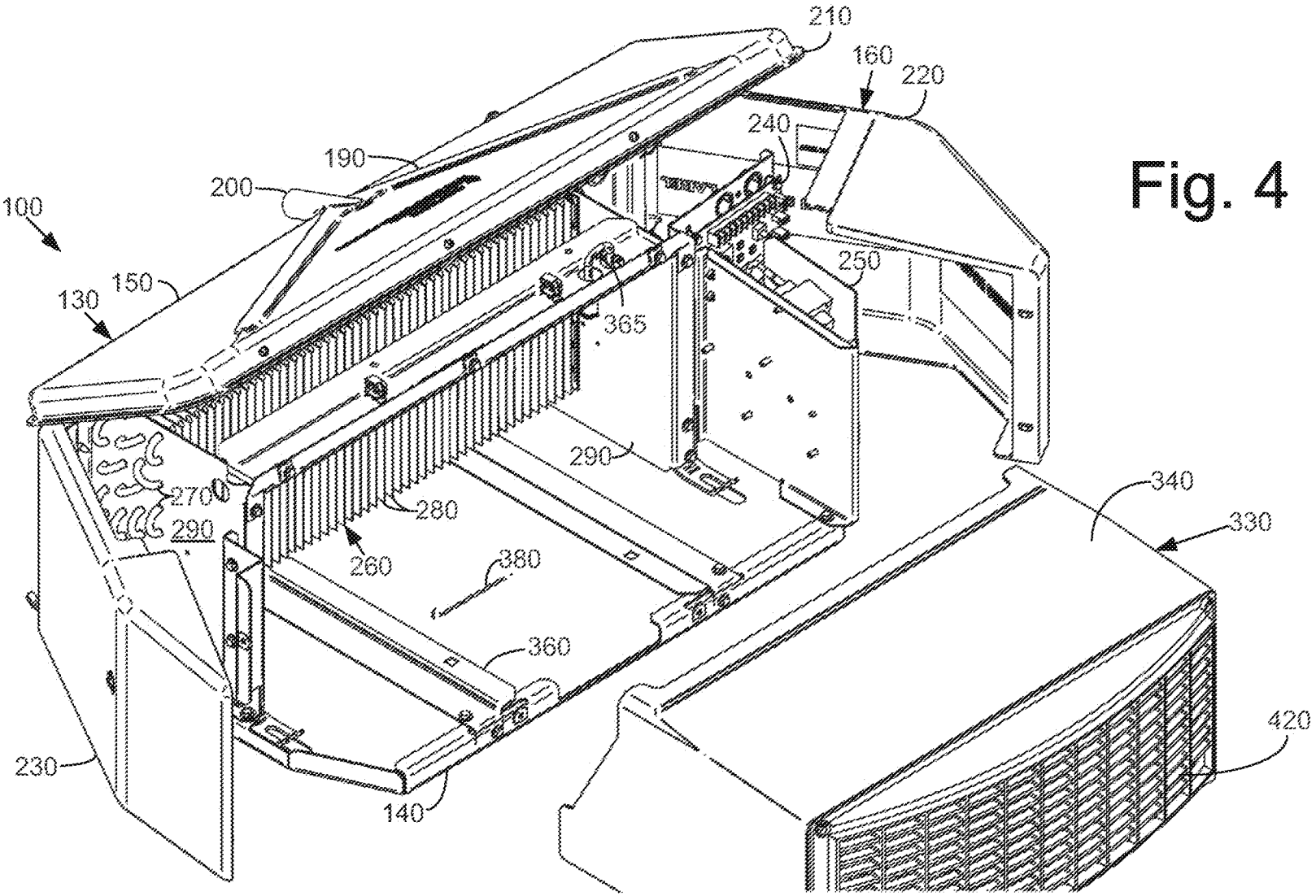
FIG. 4 is an exploded bottom perspective view of the components of the evaporator of FIG. 1.

Referring now to the drawings, in which like numerals refer to like elements throughout the several views, FIGS. 1-4 show an evaporator 100 as may be described herein. The evaporator 100 may be positioned within a cooler 110. The evaporator 100 typically is positioned on a ceiling 115 thereof. The cooler 110 may be any type of chilled enclosure and may include refrigerators, freezers, or any structure chilled below typical ambient temperatures. The cooler 110 may have any desired size, shape, or configuration. The evaporator 100 described herein is in no way limited by the type or design of the cooler 110. A drain line 120 may extend from the evaporator 100 to the exterior of the cooler 110. The drain line 120 may have any desired size, shape, or configuration. The evaporator 100 may be in communication with other types of refrigeration equipment such as the components of the refrigeration cycle described above and the like. The overall evaporator 100 may be modular in nature as will be described in more detail below such that the components thereof may be easily installed and replaced.

The evaporator 100 may include a housing 130. The housing 130 may be made in whole or in part out of molded plastics. Metals and other types of substantially rigid materials also may be used as the panel and/or as a backbone-type structure. The housing 130 may include a top panel 140, a drain pan 150, and a pair of side panels 160. The top panel 140 may include a number of mounting brackets 170 attached thereto. The mounting brackets 170 may extend from one end of the top panel 140. The top panel 140 also may have a number of mounting apertures 180 positioned therein. The mounting brackets 170 and the mounting apertures 180 may have any size, shape, or configuration. The top panel 140 may be attached to the ceiling 115 of the cooler 110 or other structure via the mounting brackets 170 and the mounting apertures 180 as well as conventional types of fasteners such as bolts and the like.

The drain pan 150 may have one or more drain channels 190 formed therein. The drain channels 190 may lead to a drain pipe 200 on one end thereof. The drain pipe 200 may extend outwardly and slightly downwardly from the drain pan 150. The drain pipe 200 may be in communication with the drain line 120. The drain pan 150 also may have a degree of slope itself leading to the drain pipe 200. The drain pan 150 also may include a raised lip 210 positioned about a periphery thereof. The raised lip 210 permits the drain pan 150 to catch water droplets on the exterior thereof. A submersible pump also may be used herein. Other configurations and other components may be used herein.

The side panels 160 may include a service access panel 220 and a non-service access panel 230. The service access panel 220 provides access to the refrigeration components as will be described in more detail below as well as an electrical module 240. The electrical module 240 includes all of the electrical components and controls for the operation of the overall evaporator 100. The electrical module 240 and the other electrical components of the overall evaporator 100 may be prewired for easy installation. A high voltage barrier panel 250 may surround the electrical module 240. A wiring diagram or other types of information may be positioned about the service access panel 220. The service access panel 220 and the non-service access panel 230 may be hinged for access thereto. Other configurations and other components may be used herein.

A coil assembly 260 may be mounted onto the top panel 140 or otherwise. The coil assembly 260 may includes a number of tubes with a number of spaced fins 280. The tubes 270 may extend through a pair of end plates 290. The tubes 270 and the fins 280 may be made out of copper, aluminum, or other types of substantially rigid materials with good heat transfer characteristics. The fins 280 may be corrugated. Other configurations and other components may be used herein.

Figure 5:
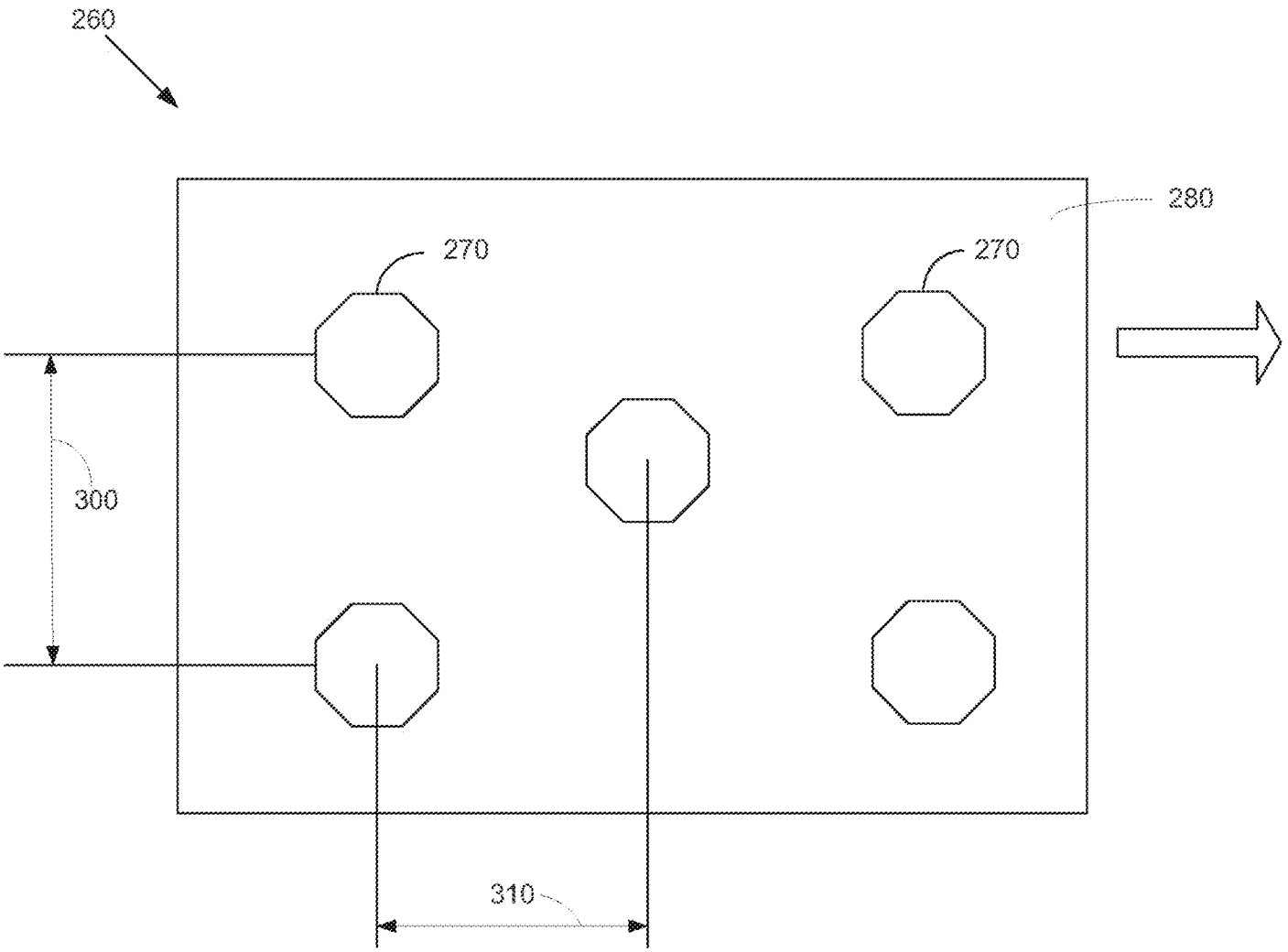
FIG. 5 is a plan view of a fin pattern as may be used with the evaporator of FIG. 1.

As is shown in FIG. 5, the coil assembly 260 may have a more open tube design than is typically found in conventional refrigeration units. For example, the tubes 270 may have an outside diameter of about seven (7) millimeters with a tube spacing 300 of about twenty-seven (27) millimeters or more and a row spacing 310 of about twenty-three (23) millimeters or more in an off-set fashion. The use of the expanded tube spacing 300, 310 thus provides less of a pressure drop therethrough and may reduce the refrigerant charge needed therein. Typically, tubes 270 with smaller diameters are positioned closer together. This "closeness", however, tends to aid in the development of frost due to the reduced span therebetween. The tube pattern described herein has smaller tube diameters but maintains the larger spacing such that the building of frost is not increased. The dimensions described herein are for purposes of example only. Other dimensions may be used herein.

The coil assembly 260 may be in communication with a refrigeration tubing/piping 320. The refrigeration tubing/piping 320 may have any desired size, shape or configuration. The refrigeration tubing/piping 320 may be in communication with other types of refrigeration components such as those described above and the like. Other components and other configurations may be used herein.

Figure 6:
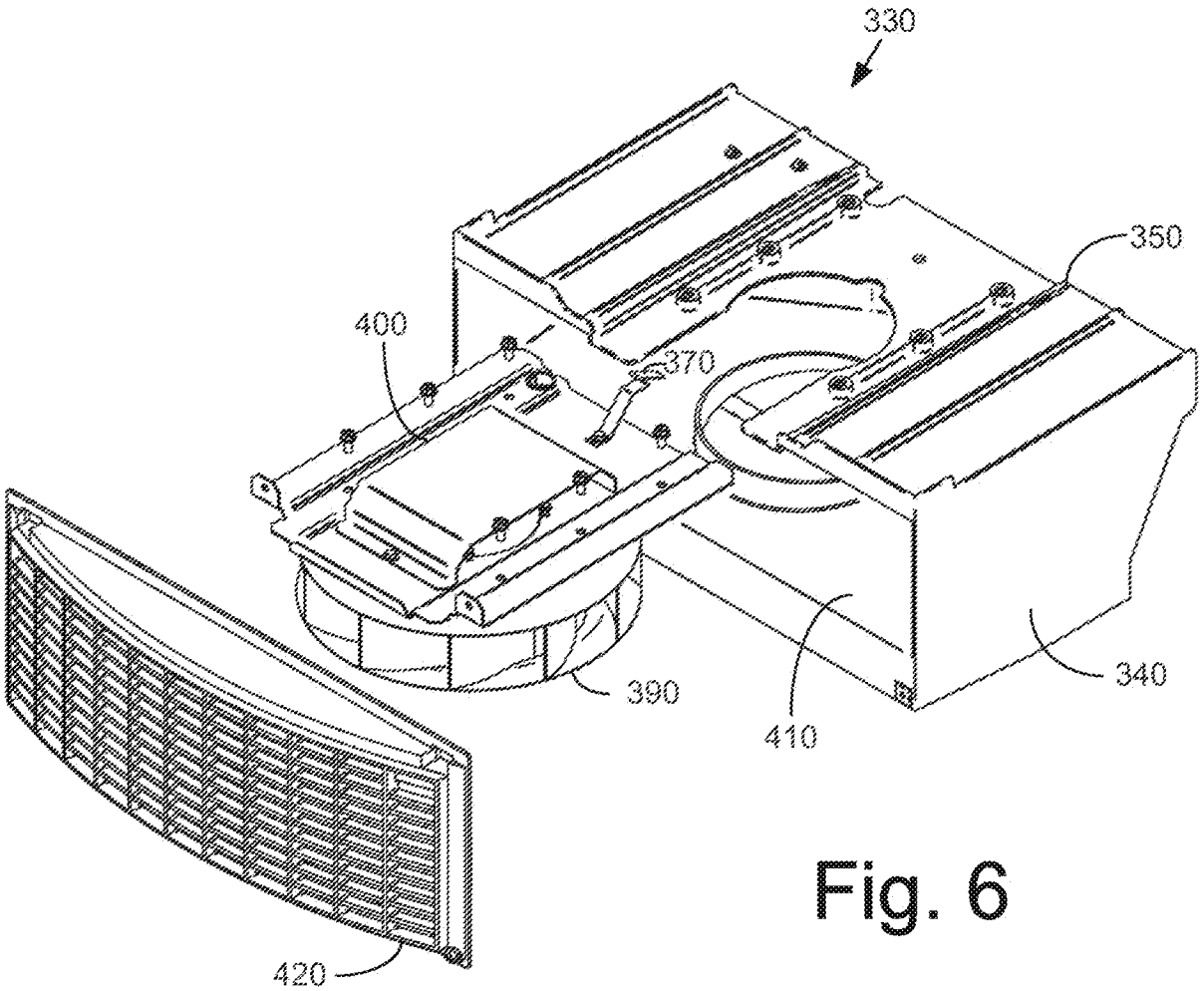
FIG. 6 is an exploded view of the components of a fan module that may be used in the evaporator of FIG. 1.

The evaporator 100 also may include a fan module 330 as is shown in FIG. 6. The fan module 330 may include a fan housing 340. The fan housing 340 may be made out of molded plastics, metals, and other types of substantially rigid materials. The fan housing 340 may have a number of mounting rails 350 positioned thereon. The mounting rails 350 may mate with a number of top panel rails 360 positioned about the top panel 140. The use of the mounting rails 350 and the top panel rails 360 allows the fan module 330 as a whole to slide in and out of the housing 130 of the evaporator 100 as a whole. A fan wiring harness 365 and the like may extend along the top panel rails 360 and/or otherwise within the housing 130 and may be in communication with the fan module 330 and the electrical module 240 and/or other controls as the fan module 330 slides therein.

The fan housing 340 also may include a locking member 370 positioned thereon. The locking member 370 may be biased into the locked positioned. The locking member 370 may mate with a receiving member 380 positioned about the top panel 140 or otherwise (including the reverse). When the fan module 330 is slid into the housing 130 of the evaporator 100, the locking member 370 and the receiving member 380 may cooperate to lock the fan module 330 into place. Other types of locking mechanism may be used herein.

The fan module 330 includes a fan 390 mounted within the fan housing 340. The fan 390 may be a backward incline centrifugal fan and the like. The backward incline centrifugal fan may have an overall reduced height as compared to conventional axial refrigeration fans. A backward incline centrifugal fan generally is used in air handlers as opposed to refrigeration units due to the ability of the fan to overcome high static pressure loads associated with duct work. The fan 390 may be a variable speed fan. The fan 390 pulls the airflow through the coil assembly 260 and turns the flow into the cooler 110 or other refrigerated space. The fan module 330 also may include a fan motor 400, one or more air plenums 410, and electronic and other controls. The electronics and the other components may be placed in communication with the electrical module 240 via the wiring harness 365 via one or more quick disconnect fittings or otherwise. Other types of fans 390, fan motors 400, and controls may be used herein. Other components and other configurations may be used herein.

The fan module 330 also includes a grill 420 so as to enclose one end of the housing 340. The grill 420 may be made out of molded plastics, metals, and other types of substantially rigid materials. The grill 420 may have any size, shape, or configuration. The grill 420 may be attached by a number of clips or other attachment means for easy access thereto and for easy cleaning.

In use, the evaporator 100 may be attached to the ceiling 115 of the cooler 110 or other type of structure, A template may be used to align the location of the mounting brackets 170 and the mounting apertures 180 so as to drill the appropriate holes and the like. Advantageously, the fan module 330 need not be positioned within the housing 130. Removing the fan module 330 makes the overall evaporator 100 lighter and makes attachment to the cooler 110 considerably easier than may be possible with known units. The coil assembly 260 and the electrical module 240 with the related wiring may be premounted to the housing 130. Once the housing 130 is installed, the fan module 330 may be slid within the housing 130 via the mounting rails 350 and the top panel rails 360. The electronics and other controls are prewired such that communication with the electrical module 340 is established as the fan module 330 slides therein. Multiple fan modules 330 may be used in a single housing 130.

Access to the electrical module 340 and the coil assembly 260 may be provided via the service access panel 220. Likewise, the fan module 330 may be quickly and easily removed from the housing 130 for repair, replacement, and/or cleaning. For example, removing the fan module 330 provides access for coil cleaning, drain pan cleaning, and the like. The fan module 330 may be slid out to an intermediate position or a retracted position or the locking member 370 may be released such that the fan module 330 may be removed completely. The fan module 330 thus may have at least an installed position, a retracted position, and a removed position. Advantageously, the fan module 330 may be removed from the housing 130 of the evaporator 100 and repaired outside of the cooler 110.

The evaporator 100 thus provides ease of installation and ease of access with a relatively low profile. For example, if existing evaporators are generally in excess of a height of about fourteen (14) inches (about 35.56 centimeters), the evaporator described herein may be about eleven (11) inches (about 27.94 centimeter) or so. These dimensions are for the purpose of comparison only and any height may be used herein. Nonetheless, the evaporator 100 described herein provides more storage room for the cooler 110 given the reduced profile. Likewise, the risk of injury also may be reduced herein.

It should be apparent that the foregoing relates only to certain embodiments of the present application and that numerous changes and modifications may be made herein by one of ordinary skill in the art without departing from the general spirit and scope of the invention as defined by the following claims and the equivalents thereof.

The invention claimed is:

1. A cooler comprising:
an enclosure comprising a ceiling;
an evaporator positioned on the ceiling and comprising:
an evaporator housing, the evaporator housing comprising a top panel and a bottom drain pan, wherein the top panel comprises a plurality of top panel rails;
a coil assembly mounted within the evaporator housing;
a fan housing positioned within the evaporator housing, wherein the fan housing comprises a grill and a plurality of mounting rails;
a drain line extending to an exterior of the cooler;
wherein the fan housing comprises a replaceable fan; and
wherein the plurality of mounting rails of the fan housing mate with the plurality of top panel rails of the evaporator housing allowing the fan housing to slide in and out of the evaporator housing.

2. The cooler of claim 1, wherein the fan housing comprises a fan assembly therein.

3. The cooler of claim 2, wherein the fan assembly comprises the replaceable fan, a fan motor, and a fan mounting bracket.

4. The cooler of claim 1, wherein the replaceable fan comprises a backward incline centrifugal fan.

5. The cooler of claim 1, wherein the grill is attached to the fan housing using a plurality of clips.

6. The cooler of claim 1, wherein the fan housing comprises a locking member positioned thereon.

7. The cooler of claim 6, wherein the locking member is configured to mate with a receiving member positioned around the top panel of the evaporator housing thereby locking the fan housing in place.

8. The cooler of claim 1, wherein the replaceable fan comprises a variable speed fan.

9. A cooled enclosure comprising:
an interior surface;
an evaporator positioned on the interior surface and comprising:
an evaporator housing, the evaporator housing comprising a top panel and a bottom drain pan, wherein the top panel comprises a plurality of top panel rails;
a coil assembly mounted within the evaporator housing;
a fan housing positioned within the evaporator housing, wherein the fan housing comprises a grill and a plurality of mounting rails;
wherein the plurality of mounting rails of the fan housing mate with the plurality of top panel rails of the evaporator housing allowing the fan housing to slide in and out of the evaporator housing; and
a replaceable fan positioned within a fan aperture of the fan housing, wherein the replaceable fan is configured to direct airflow out of the fan housing through the grill.

10. The cooled enclosure of claim 9, comprising a drain line extending to an exterior of the cooled enclosure and operable to direct condensation to an exterior of the cooled enclosure.

11. The cooled enclosure of claim 9, wherein the replaceable fan comprises a backward incline centrifugal fan.

12. The cooled enclosure of claim 9, wherein the replaceable fan comprises a variable speed fan.

13. The cooled enclosure of claim 9, wherein:
the fan housing comprises a fan assembly therein; and
the fan assembly comprises the replaceable fan, a fan motor, and a fan mounting bracket.

14. The cooled enclosure of claim 9, wherein the grill is attached to the fan housing using a plurality of clips.

15. The cooled enclosure of claim 1, wherein the fan housing comprises a locking member positioned thereon.

16. The cooled enclosure of claim 15, wherein the locking member is configured to mate with a receiving member positioned around the top panel of the evaporator housing thereby locking the fan housing in place.

17. A freezer comprising:
an interior surface;
an evaporator positioned on the interior surface and comprising:
an evaporator housing, the evaporator housing comprising a top panel and a bottom drain pan, wherein the top panel comprises a plurality of top panel rails;
a coil assembly mounted within the evaporator housing;
a fan housing positioned within the evaporator housing, wherein the fan housing comprises a grill and a plurality of mounting rails;
wherein the plurality of mounting rails of the fan housing mate with the plurality of top panel rails of the evaporator housing allowing the fan housing to slide in and out of the evaporator housing; and
a replaceable fan positioned within a fan aperture of the fan housing, wherein the replaceable fan is configured to direct airflow out of the fan housing through the grill; and wherein the fan housing is configured to accommodate a differently sized replaceable fan.

18. The freezer of claim 17, wherein the replaceable fan comprises a backward incline centrifugal fan.

19. The freezer of claim 17, wherein the replaceable fan comprises a variable speed fan.

20. The freezer of claim 17, comprising a drain line extending to an exterior of the cooled enclosure and operable to direct condensation to an exterior of the cooled enclosure.

* * * * *